US006729916B2

(12) United States Patent
Pan

(10) Patent No.: US 6,729,916 B2
(45) Date of Patent: May 4, 2004

(54) BOARD-TO-BOARD ELECTRICAL CONNECTOR AND METHOD FOR MANUFACTURING SAME

(75) Inventor: Weihua Pan, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 138 days.

(21) Appl. No.: 10/269,137

(22) Filed: Oct. 10, 2002

(65) Prior Publication Data

US 2003/0216087 A1 Nov. 20, 2003

(30) Foreign Application Priority Data

May 17, 2002 (TW) ..... 91110317 A

(51) Int. Cl.[7] ..... H01R 13/02

(52) U.S. Cl. ..... 439/885; 439/83; 439/660; 439/751; 439/65; 29/874; 29/882

(58) Field of Search ..... 434/885, 891, 434/629, 630, 631, 632, 83, 733.1, 751, 65, 660; 29/874, 882

(56) References Cited

U.S. PATENT DOCUMENTS 2,995,617 A * 8/1961 Mexinoff et al. ..... 174/153 R
4,568,136 A * 2/1986 Reuss ..... 339/176
5,175,928 A * 1/1993 Grabbe ..... 29/884
5,848,920 A * 12/1998 Klein et al. ..... 439/885
6,113,438 A * 9/2000 O'Sullivan ..... 439/470
6,139,377 A * 10/2000 Chen ..... 439/885
6,196,886 B1 * 3/2001 Sato ..... 439/885
6,406,338 B1 * 6/2002 Endo et al. ..... 439/885

* cited by examiner

*Primary Examiner*—Truc Nguyen
(74) *Attorney, Agent, or Firm*—Wei Te Chung

(57) ABSTRACT

An electrical connector (1) includes a housing (2) receiving contacts (3). The housing includes a central island portion (20) surrounded by connected sidewalls. The island portion is separated from the sidewalls by a moat-like mating groove. Receiving slots (200) each including a first channel (2000) and a second channel (2002) are defined in each of opposite sides of the island portion, the first channel being wider than the second channel. Each contact is received in a corresponding receiving slot, and includes a contact portion (32), a terminal portion (34) and a medial portion (30). In manufacturing, each of two series of contacts is connected with a common operation carrier (6). The terminal portion of each contact has an L-shaped pull portion (56). Pushing force is applied on the operation carriers. Then pulling force is applied at the pull portions until the terminal portions are completely exposed outside of the housing.

1 Claim, 6 Drawing Sheets

BOARD-TO-BOARD ELECTRICAL CONNECTOR AND METHOD FOR MANUFACTURING SAME

BACKGROUND OF THE INVENTION

1. Field of the Invention

The present invention relates to a board-to-board electrical connector and a method for effectively make such connector, especially a method whereby parts of the connector can be installed quickly without causing damage.

2. Description of the Related Art

As detailed in pages 1737–1755 of Proceedings of 1990 National Electronic Packaging and Production Conference (NEPCON WEST'90) (V01.2), board to board electrical connectors have been widely used and applied in all kinds of electrical equipment to electrically connect two separate Printed Circuit Boards (PCBs). A conventional board-to-board connector comprises an insulative housing defining a plurality of channels, and a plurality of conductive contacts respectively received in the channels. Each contact comprises a medial portion, an arcuate resilient contact portion extending from the medial portion, and a terminal portion. The terminal portion extends substantially perpendicularly from the medial portion, and is used for soldering to a respective pad on a lower PCB by Surface Mounting Technology (SMT) soldering.

The conventional process for placing the contacts in the housing is to push the contacts into the channels to a certain extent with a common carrier that interconnects either the contact portions or the terminal portions of the contacts. If the carrier connects with the terminal portions, the contacts must be installed into the channels from the bottom face of the housing.

However, during the process of installing the contacts into the housing, the housing applies force on the contacts in a direction opposite to the direction of installation. This renders the housing liable to disengage from the contacts. In particular, when a mating complementary connector is detached from the board-to-board connector in normal use, the housing is prone to separate from the contacts. In addition, excessive or uneven pushing force may be exerted on the contacts during the installation process. The contacts may be improperly positioned in the channels, and the contact portions may be distorted. As a result, reliable electrical engagement between the contacts and conductors of the complementary connector may be impaired. Furthermore, the contacts are usually gold-plated for better electrical performance. If the contacts or the connector have to be discarded, this is costly.

Hence, a new board-to-board connector manufactured by an improved method is required to overcome the above-described disadvantages.

SUMMARY OF THE INVENTION

An object of the present invention is to provide an electrical connector which enables safe installation of its contacts in its housing, thereby facilitating reliability of the contacts and effective electrical engagement of the connector with a complementary connector.

Another object of the present invention is to provide a method for manufacturing an electrical connector which enables safe installation of its contacts in its housing, thereby reducing defect run rates in mass production facilities.

A further object of the present invention is to provide an electrical connector having contacts reliably secured in a housing thereof.

In order to achieve the aforementioned objects, an electrical connector in accordance with a preferred embodiment of the present invention comprises an insulative housing receiving a plurality of conductive contacts. The housing comprises a central island portion surrounded by connected sidewalls. The island portion is separated from the sidewalls by a moat-like mating groove. A plurality of closely-spaced receiving slots is defined in each of opposite longitudinal sides of the island portion. Each slot comprises a first channel and a second channel. If a transverse cross-section of the housing is viewed, the first channel is wider than the second channel. Each contact comprises a contact portion, a terminal portion, and a medial portion which connects the contact portion with the terminal portion. The contact portion is flexible, and adapted to engage a mating contact of a complementary connector. The terminal portion extends approximately perpendicularly from the medial portion, and protrudes out of the bottom face of the housing for soldering to a printed circuit board.

In manufacturing the electrical connector, two series of contacts are made, one series for each longitudinal side of the island portion of the housing. Each series of contacts is stamped from a sheet of conductive metallic material. The series of contacts is connected with a common operation carrier. The terminal portion of each contact extends at a slight angle from the medial portion, and an L-shaped pull portion is formed at a distal end of the terminal portion. The series of contacts are inserted into its corresponding slots of the housing by applying force on the operation carrier. The pull portions are pulled away from the housing in a direction parallel to the slots until the terminal portions are completely exposed outside of the housing.

Other objects, advantages and novel features of the present invention will become more apparent from the following detailed description when taken in conjunction with the accompanying drawings. A copending application Ser. No. 10/243,427 with the same assignee, discloses a somewhat close approach.

DESCRIPTION OF THE PREFERRED EMBODIMENT

Figure 1:
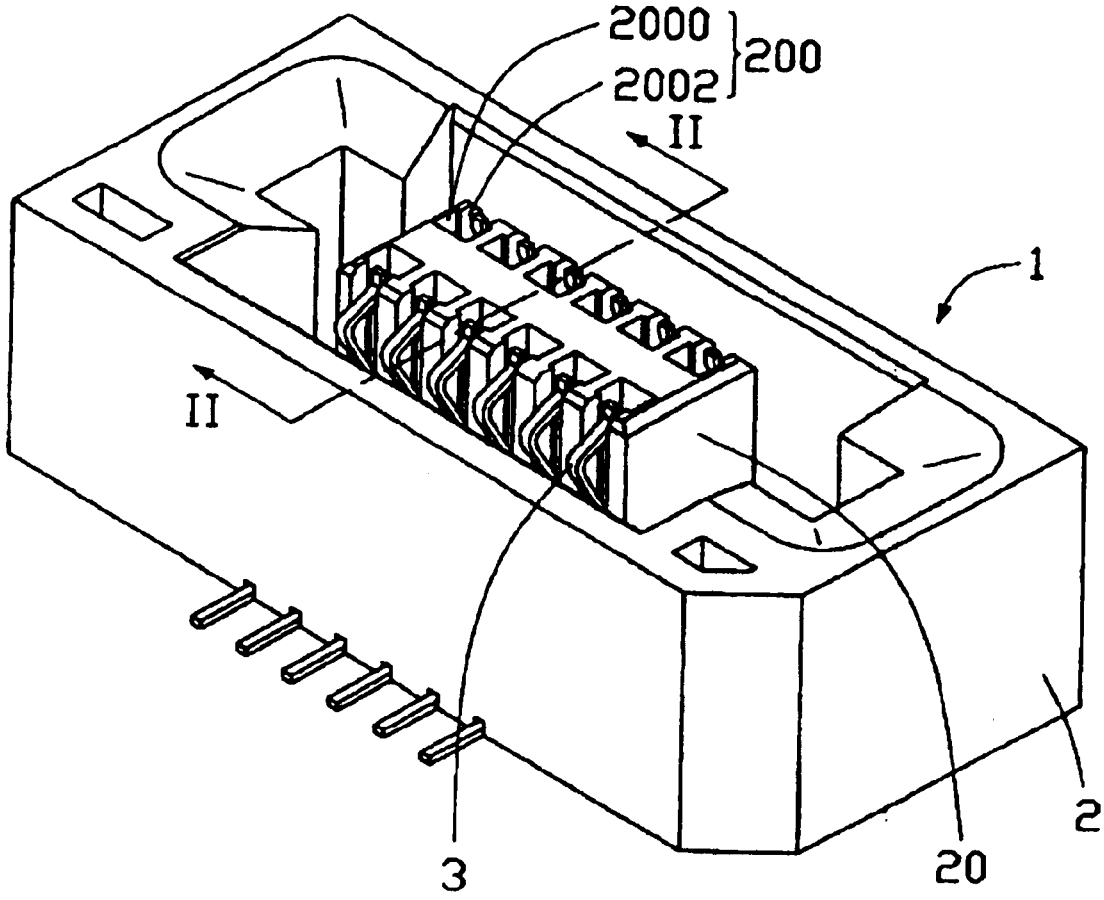
FIG. 1 is a perspective view of an electrical connector in accordance with a preferred embodiment of the present invention.

Reference will now be made to the drawing figures to describe the present invention in detail.

Referring to FIG. 1, an electrical connector 1 of the present invention comprises an insulative housing 2 having a top mating face and an opposite bottom face, and a plurality of conductive contacts 3 received in the housing 2.

The housing 2 forms a central island portion 20. The island portion 20 is surrounded by connected sidewalls of the housing 2, but separated from the sidewalls by a moat-like mating groove. A plurality of closely-spaced receiving slots 200 is defined in each of opposite longitudinal sides of the island portion 20. The slots 200 span between the mating face and the bottom face. Each slot 200 comprises a first channel 2000 and a second channel 2002.

Figure 2:
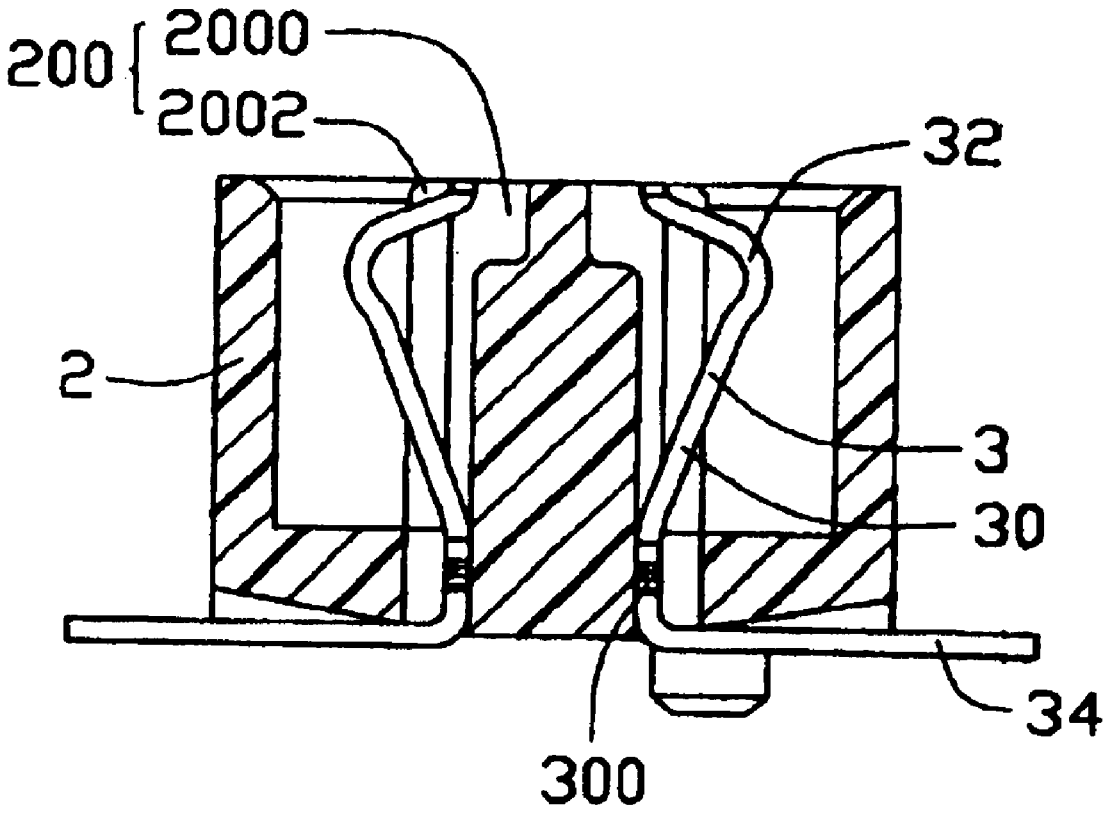
FIG. 2 is a cross-sectional view of the electrical connector of FIG. 1, taken along line II—II of FIG. 1.

Referring also to FIG. 2, if a transverse cross-section of the housing 2 is viewed, the first channel 2000 is slightly wider than the second channel 2002.

Each contact 3 comprises a medial portion 30, an arcuate resilient contact portion 32 extending from one end of the medial portion 30, and a terminal portion 34 extending from an opposite end of the medial portion 30 in a direction approximately perpendicular to the medial portion 30. The medial portion 30 further forms a plurality of barbs 300 on each of opposite lateral edges thereof, for interferential engagement of the medial portion 30 in its corresponding slot 200 of the housing 2. The barbs 300 are securely received in the first channel 2000 such that the first channel 2000 is expanded in the vicinity of the barbs. Thus the contact 3 is firmly fastened in the slot 200. The contact portion 32 is flexible, and adapted to engage a mating contact of a complementary connector (not shown). The terminal portion 34 extends approximately perpendicularly from the medial portion 30, and protrudes out of the bottom face of the housing 2 for soldering to a printed circuit board (not shown).

A preferred method for manufacturing the electrical connector 1 will now be described in detail.

Figure 3A:
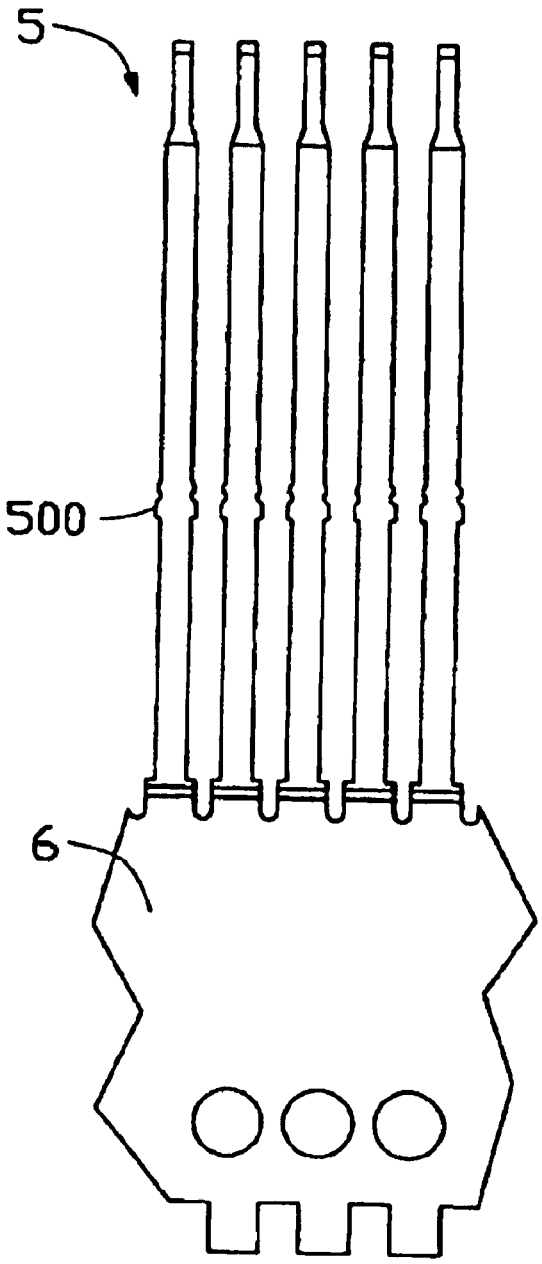
FIG. 3A is a front plan view of a series of contacts of the electrical connector of FIG. 1 connected with a common operation carrier.
Figure 3B:
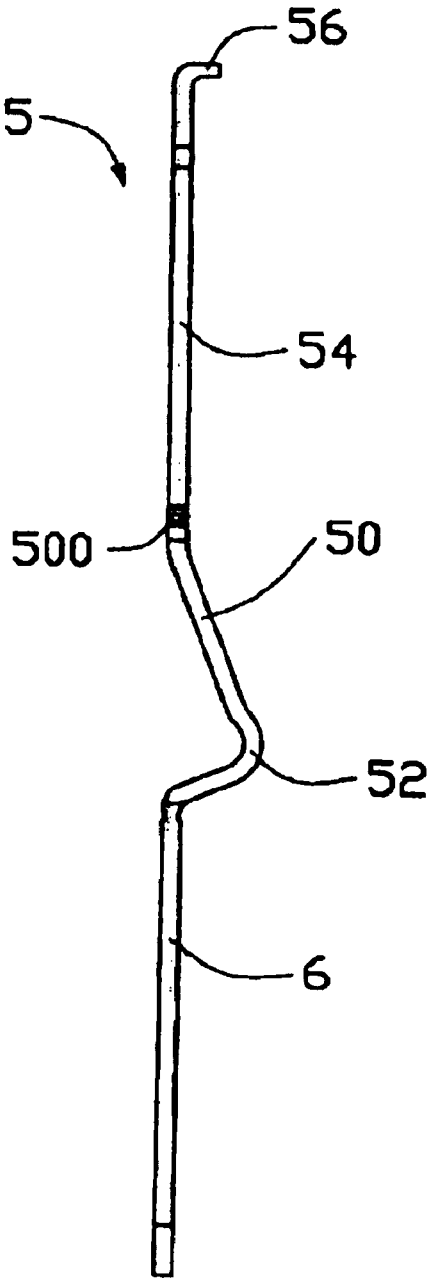
FIG. 3B is a side plan view of FIG. 3A.

Firstly, referring to FIGS. 3A and 3B, two series of contacts 5 are made, one series for each longitudinal side of the island portion 20 of the housing 2. Each series of contacts 5 is stamped from a sheet of conductive metallic material. Each contact 5 comprises a medial portion 50, a contact portion 52 extending from the medial portion 50, a terminal portion 54 extending at a slight angle from the medial portion 50, and an L-shaped pull portion 56 formed at a distal end of the terminal portion 54. In addition, a plurality of barbs 500 is formed on each of opposite lateral edges of the medial portion 50. The series of contacts 5 is connected with a common operation carrier 6. The operation carrier 6 is adapted to simultaneously install the contacts 5 into the corresponding slots 200 of the housing 2 during the assembly process.

Figure 4A:
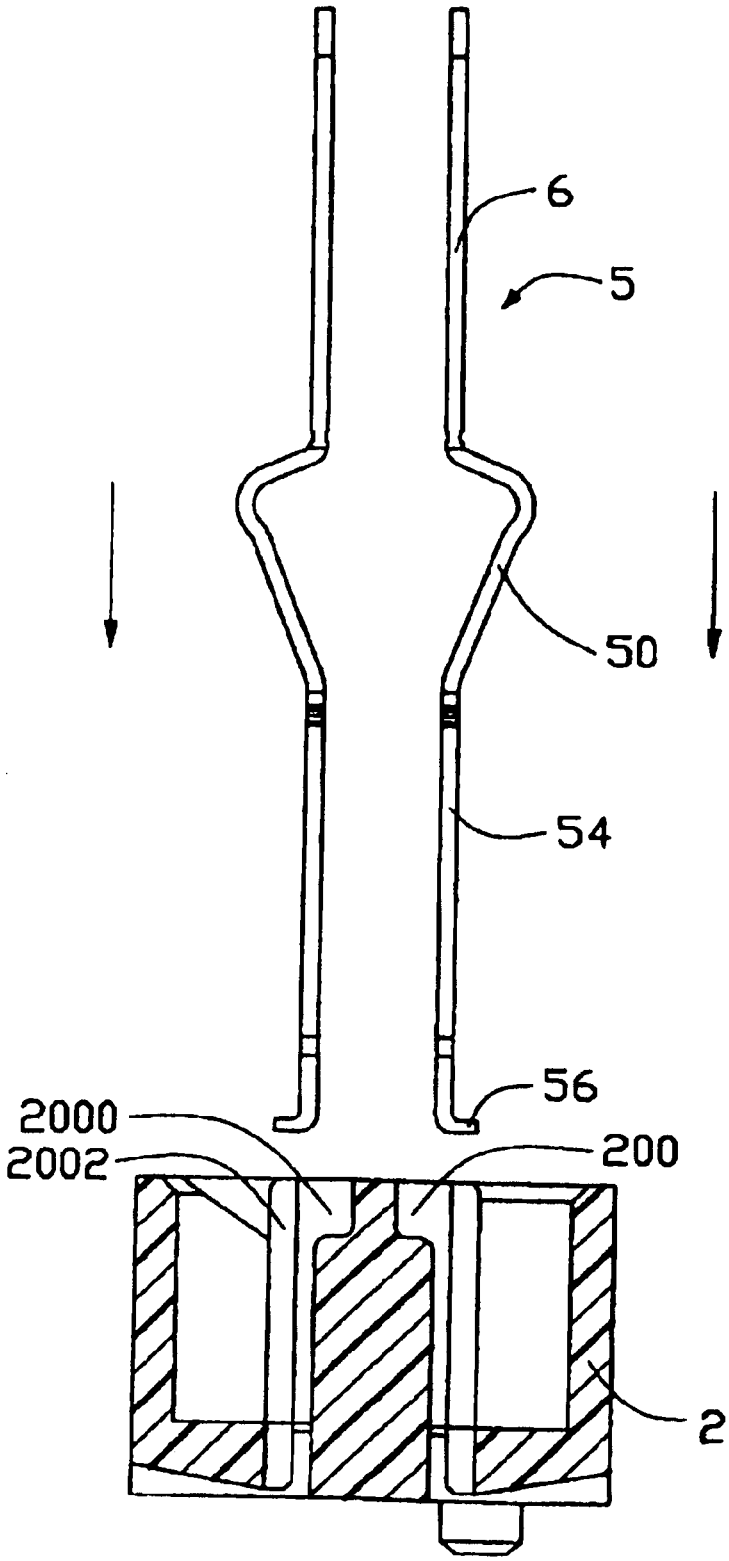
FIGS. 4A~4C are cross-sectional views of the electrical connector in accordance with the preferred embodiment of the present invention, showing successive steps of a preferred method for manufacturing the electrical connector.

Secondly, referring to FIG. 4A, the series of contacts 5 is inserted into the corresponding slots 200 of the housing 2 by applying force on the operation carrier 6. The medial and terminal portions 50 of each contact 5 pass through only the first channel 2000 of the slot 200, while the pull portion 56 of each contact 5 passes through both the first channel 2000 and the second channel 2002 of the slot 200.

Figure 4B:
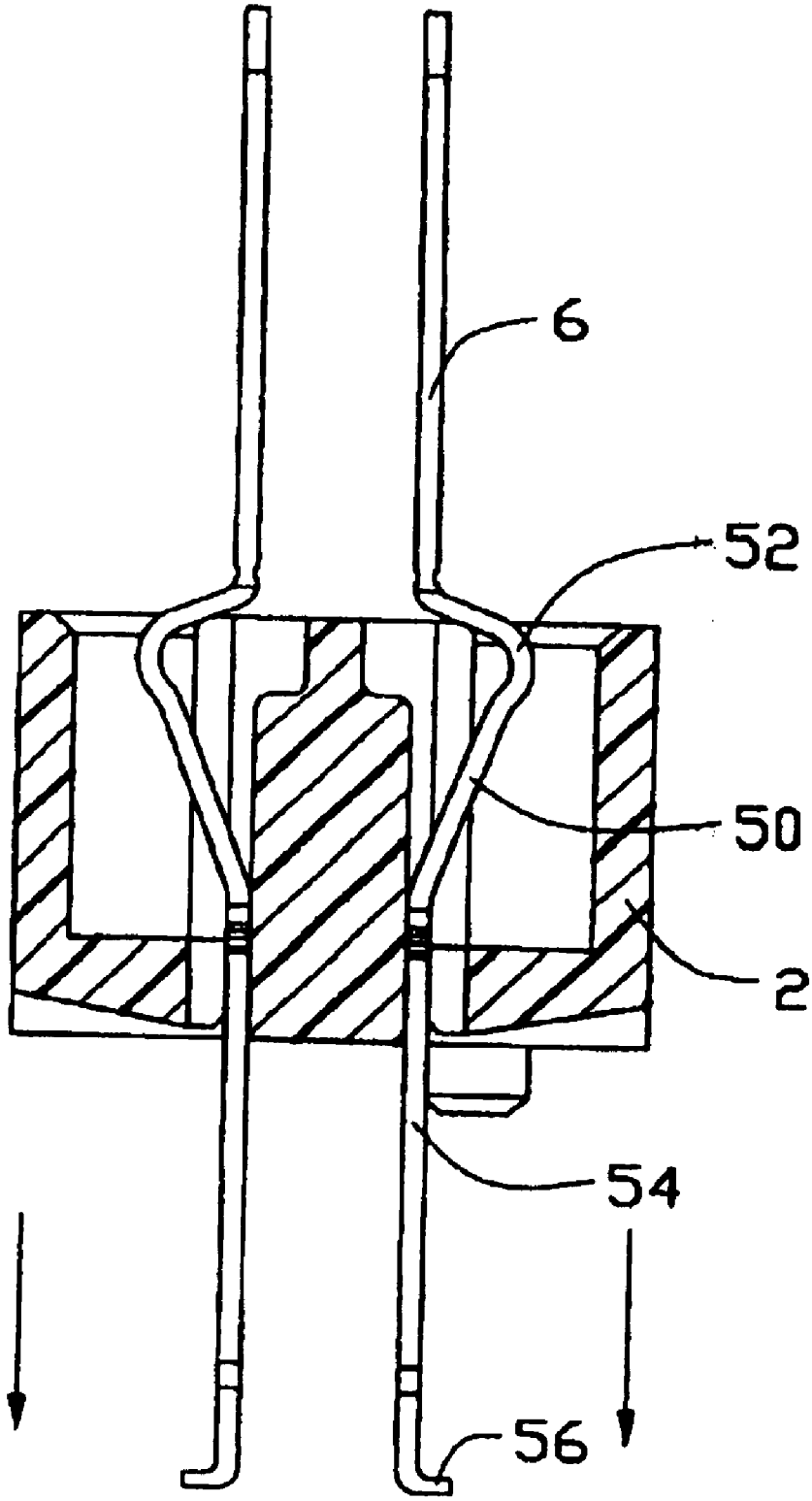

Thirdly, referring to FIG. 4B, the pull portions 56 of the contacts 5 protrude from the bottom face of the housing 2. The pull portions 56 are pulled away from the housing 2 in a direction parallel to the slots 200 until the terminal portions 54 are completely exposed outside of the housing 2.

Figure 4C:
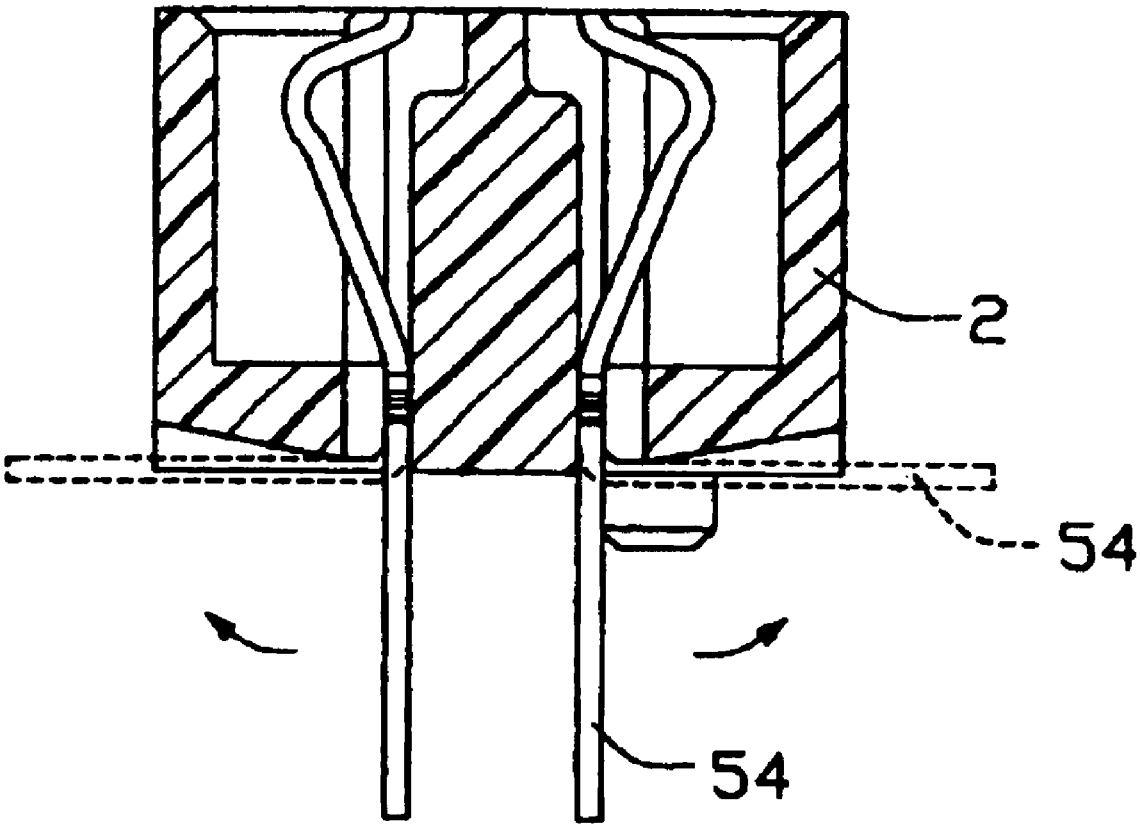

Fourthly, referring to FIG. 4C, the operation carrier 6 is cut off from the adjacent contacts 5. The pull portions 56 are cut off from the terminal portions 54 of the contacts 5. The terminal portions 54 are bent to positions approximately perpendicular to the corresponding medial portions 50 of the contacts 5.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

What is claimed is:

1. An electrical connector comprising:

an insulative housing defining a plurality of receiving slots therein;

a plurality of conductive contacts received in the receiving slots, each of the contacts comprising a contact portion adapted to engage a complementary connector, a terminal portion for attachment to a circuit substrate, and a medial portion disposed between the contact portion and the terminal portion and adapted to fix the contact in a corresponding receiving slot; wherein during assembly of the connector, the terminal portion of at least one of the contacts comprises a severable distal portion, and the contact portions of at least two adjacent of the contacts are separably connected with an operation element, whereby an operation force can be applied at said operation element and said terminal portion in a same direction;

wherein the operation element is an operation carrier, and the distal portion is a pull portion;

wherein the operation carrier is used to apply a pushing force on contact portions connected therewith, whereby said contact portions are partly received in corresponding slots of the housing;

wherein the pull portion is used for applying a pulling force thereat, whereby said partially received contact portions are moved further into the housing to fasten the corresponding contacts in the corresponding receiving slots;

wherein each of the receiving slots further defines a first channel and a second channel, and the first channel is slightly wider than the second channel;

wherein the pull portion passes through the second channel of the corresponding slot when the pushing force is applied on the operation carrier;

wherein the medial portion of each of the contacts forms a plurality of barbs adapted to interferentially engage with at least one inner side wall of the housing at the first channel of the corresponding receiving slot.

* * * * *